US007343630B2

(12) United States Patent
Lee

(10) Patent No.: US 7,343,630 B2
(45) Date of Patent: Mar. 18, 2008

(54) SHADE CURTAIN FREELY ATTACHABLE TO AND DETACHABLE FROM A HAT

(76) Inventor: Sam Jun Lee, 303-301, Daedong Firenze Apt., Sukbong Town, 30-7, Sammoonli Jangyoo, Gimhae, Gyeongnam (KR)

( * ) Notice: Subject to any disclaimer, the term of this patent is extended or adjusted under 35 U.S.C. 154(b) by 58 days.

(21) Appl. No.: 11/505,188

(22) Filed: Aug. 16, 2006

(65) Prior Publication Data

US 2007/0050889 A1 Mar. 8, 2007

(30) Foreign Application Priority Data

Aug. 16, 2005 (KR) ..... 10-2005-0074789

(51) Int. Cl.
*A42B 1/24* (2006.01)

(52) U.S. Cl. ..... 2/175.6; 2/209.13; 2/184.5

(58) Field of Classification Search ..... 2/209.13, 2/175.6, 184.5, 12, 15; 351/155
See application file for complete search history.

(56) References Cited

U.S. PATENT DOCUMENTS 2,669,717 A * 2/1954 Diggs ..... 2/9
3,383,155 A * 5/1968 Bourke ..... 351/155
4,869,586 A * 9/1989 Chung ..... 351/158
5,544,361 A * 8/1996 Fine et al. ..... 2/10
5,907,868 A * 6/1999 Schleger et al. ..... 2/10
6,233,745 B1 * 5/2001 Friesen ..... 2/172
6,966,072 B1 * 11/2005 Kobayashi ..... 2/209.13
6,996,852 B1 * 2/2006 Cabrera ..... 2/172
7,125,116 B1 * 10/2006 Chiu ..... 351/155
7,207,673 B1 * 4/2007 Ho ..... 351/155

FOREIGN PATENT DOCUMENTS

KR 10-0471668 3/2005

* cited by examiner

*Primary Examiner*—Katherine Moran
(74) *Attorney, Agent, or Firm*—Jordan and Hamburg LLP

(57) ABSTRACT

Disclosed is a shade curtain for screening a user's face from the sunlight or the insect, which gives a considerable reduction in costs and a considerable improvement in value of commodities. The shade curtain is freely attachable to and detachable from a hat or a safety helmet. Pluralities of supporting plates enclose side circumferential-edges of the hat or the safety helmet. A net-shaped sun shades is attached to and extends downwards from outer peripheral edges of the supporting plates and supporting ribs for supporting front upper edges of the net-shaped sun shade. The supporting ribs are hingedly mounted to front ends of the clipping parts. The clipping parts have a "ㄷ" shape sectional surface respectively, in which a jaw for holding the visor fitted between an upper clipping plate and a lower clipping plate of the clipping parts is formed at an entrance there between. A locking device is provided at a joint between the clipping parts and the supporting ribs. The locking device comprises a locking protrusion protruding from the upper surface of the clipping part and a plurality of semispherically-shaped protrusions protruding from the front end of the supporting ribs.

8 Claims, 8 Drawing Sheets

SHADE CURTAIN FREELY ATTACHABLE TO AND DETACHABLE FROM A HAT

BACKGROUND OF THE INVENTION

1. Field of the Invention

The present invention relates generally to a shade curtain freely attachable to and detachable from a hat, and more particularly to a shade curtain freely attachable to and detachable from a hat, which gives a considerable reduction in costs and a considerable improvement in value of commodities by simplifying the structure and by decorating the outward appearance of the shade curtain for screening a user's face from the sunlight or the insect, which is much more convenient to use than a conventional shade curtain for a hat by employing a locking means for stably supporting a net-shaped sun shade that can be freely open backwards from a position near the face portions of the user as needed, and which provides the user with more options and features.

2. Description of the Related Art

Korean Patent No. 10-0471668 issued to this applicant on Feb. 2, 2005 in the title of "Device for attaching sun-shade on the brim of a hat" discloses a device having a shade curtain freely attachable to and detachable from a brim of a hat. According to this Korean Patent, a user can use the hat as a special-purpose hat for screening the user's face from the sunlight or the insect in a state that the device having the shade curtain is mounted onto the brim of the hat. Alternatively, the user also can use the hat as a general-purpose hat after removing the device having the shade curtain from the brim of the hat. After removing the device, the user can freely fold the device having the shade curtain and thus an entire size thereof may be reduced as much as possible and become compact, such that a handling and custody are easy. Meanwhile, sunglasses or a flash lamp can be selectively mounted to the device for attaching the sun-shade on the brim of the hat, as needed.

One drawback of the hat according to the invention disclosed in the Korean Patent No. 10-0471668 is that the structure of mounting the device for attaching the sun-shade on the brim of the hat is complicated, and thereby resulting in the generation of excess manufacturing cost. This leads to the economical waste for the patient. The mounting of sunglasses or a flash lamp to the device for attaching the sun-shade on the brim of the hat is not a common affair. Therefore, it is not necessary for the user to mount sunglasses or a flash lamp to the device before using the hat.

In more detail, the hat according to the invention disclosed in the Korean Patent No. 10-0471668 includes a body plate on which a sun-shade is mounted, circular arc-shaped supporting ribs, which are attached to a front part of the sun-shade, and a pair of fitting members for mounting the device to the brim of the hat, which are coupled to both sides of a radial front portion of the body plate. By inserting a plurality of protrusions, which protrude from the surfaces of the fitting members, into the holes formed through the supporting ribs and the body plate respectively, and then the body plate, the supporting ribs and the fitting members are integrally combined together. Accordingly, the structure of metallic moulds, which are essential to manufacture these constitutional parts, is complicated. Also, the number of the metallic moulds is increased. Consequently, the manufacturing cost is highly increased. In addition, the outward appearance of the hat is not good.

When a user wears the hat on which the net-shaped sun shade is attached over the outer circumferential edges of the body plate and the supporting ribs, then the net-shaped sun shade may screen the user's face. At this time, the user may have tightness. Accordingly, the user commonly wants to open the net-shaped sun shade backwards from a position near the face portions of the user. Since one end of the supporting ribs is hingedly connected to the front portions of the body plate respectively, the net-shaped sun shade is not satisfactorily fixed at the open position and thereby it may be slipped down. Consequently, it is hard to smoothly open the net-shaped sun shade backwards from a position near the face portions of the user.

SUMMARY OF THE INVENTION

The present invention solves the foregoing problems. It is an object of the present invention to a shade curtain freely attachable to and detachable from a hat, which gives a considerable reduction in costs and a considerable improvement in value of commodities by simplifying the structure and by decorating the outward appearance of the shade curtain for screening a user's face from the sunlight or the insect, which is much more convenient to use than a conventional shade curtain for a hat by employing a locking means for stably supporting a net-shaped sun shade that can be freely open backwards from a position near the face portions of the user as needed, and which provides the user with more options and features. In order to simplify the structure of the shade curtain, some structures for mounting sunglasses or a flash lamp or peripheral parts to the device have been removed. Additionally, a supporting plate, which is correspond to the conventional body plate, and clipping parts, which are correspond to the conventional fitting members, are integrally formed with each other. In order to freely open the net-shaped sun shade backwards from a position near the face portions of the user as needed and to satisfactorily fix it the open position, the locking means is provided at a connecting position between the front ends of both supporting ribs for supporting the visor of the hat and the clipping parts.

In order to achieve this object, the present invention provides a shade curtain freely attachable to and detachable from a hat, the shade curtain including clipping parts being attachable to and detachable from both sides of a visor of the hat, supporting plates for enclosing side circumferential-edges of the hat respectively, net-shaped sun shades being attached to and extending downwards from outer peripheral edges of the supporting plates, and supporting ribs for supporting front upper edges of the net-shaped sun shades respectively, which are hingedly mounted to front ends of the clipping parts respectively, characterized in that:

the clipping parts have a "ㄷ" shape sectional surface respectively, in which a jaw for holding the visor fitted between an upper clipping plate and a lower clipping plate of the clipping parts is formed at an entrance there between, in which the supporting plates are made of a thin plate and they are integrally coupled to the outside and the rear side of the clipping parts respectively, in which a hinge pin protrudes from an upper surface of the front end of the clipping parts respectively, and a hinge hole is formed through a front end of supporting rib respectively, and thereby the hinge pin is hingedly inserted into the hinge hole, in which a locking means is provided at a joint between the clipping parts and the supporting ribs respectively, in which a fitting element protrudes one side surface of a lower portion of one supporting rib, and an insertion element having a uneven part, which is correspond to the fitting element, is formed at a lower end of the other supporting rib, and thereby the insertion element is inserted into the fitting element.

As described above, the shade curtain according to the present invention includes the supporting plate on which the net-shaped sun shade is attached and the clipping part combined to the visor. At this time, the supporting plate and the clipping part are integrally formed with each other. A locking means is installed at a joint between the front ends of both supporting ribs for supporting the front portion of the net-shaped sun shade and the clipping part. Accordingly, it is possible to obtain a considerable reduction in costs by simplifying the structure of the sun shade. In addition, it is possible to make the user much more conveniently use the shade curtain than a conventional shade curtain for a hat due to the operation of the locking means.

BRIEF DESCRIPTION OF THE DRAWINGS

The above objects and other characteristics and advantages of the present invention will become more apparent by describing in detail preferred embodiments thereof with reference to the attached drawings, in which.

DETAILED DESCRIPTION OF THE INVENTION

Figure 1:
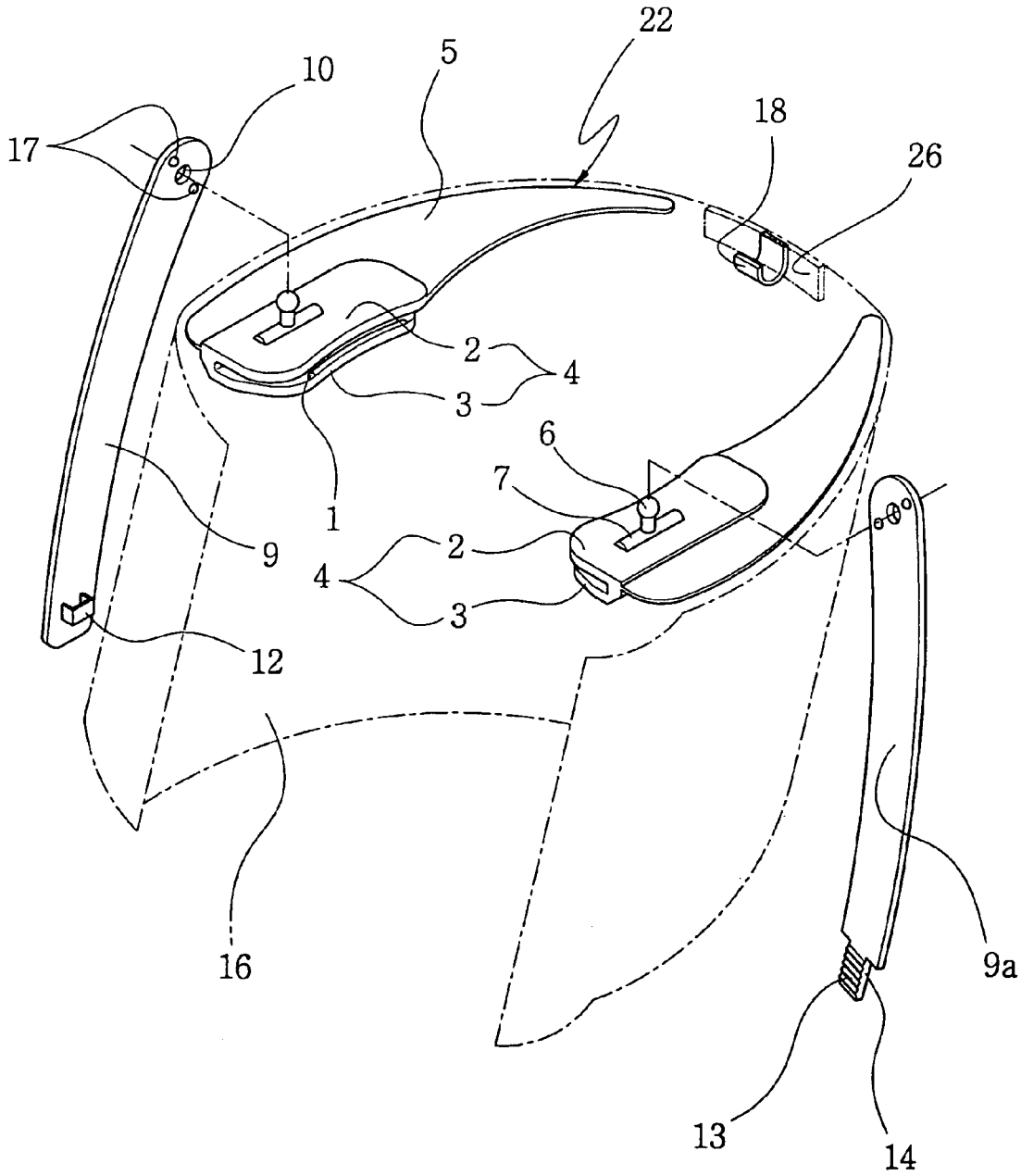
FIG. 1 is an exploded perspective view of a shade curtain freely attachable to and detachable from a hat according to a first embodiment of the present invention.

Hereinafter, a shade curtain freely attachable to and detachable from a hat according to a preferred embodiment of the present invention will be explained in more detail with reference to the accompanying drawings FIGS. 1 to 9.

A shade curtain freely attachable to and detachable from a hat according to a preferred embodiment of the present invention includes a pair of clipping parts 4, which are attachable to and detachable from both sides of a visor 20 of a hat 19, and a pair of supporting plates 5 enclosing a side circumferential-edge of the hat 19 respectively, which are installed at the clipping parts 4. A net-shaped sun shade 16 is shown attached to and extends downwards from an outer peripheral edge of the supporting plates 5. Supporting ribs 9,9*a* for supporting a front upper edge of the net-shaped sun shade 16 at both sides thereof are hingedly mounted to a front end of the clipping part 4, respectively.

Referring to FIGS. 1 to 5, in the first embodiment according to the present invention, the clipping part 4 has a "⊏"shaped section respectively, and a jaw 1 for holding the visor 20 fitted between an upper clipping plate 2 and a lower clipping plate 3 is provided at an entrance there between. That is, a half of the jaw 1 protrudes downwards from an outer circumferential-edge of the upper clipping plate 2 and other half of the jaw 1 protrudes upwards from an outer circumferential-edge of the lower clipping plate 3, and thereby the complete jaw 1 is created between the upper clipping plate 2 and the lower clipping plate 3 through which the visor 20 goes in and out. A supporting plate 5 is integrally coupled to an outside and a rear side of the clipping part 4. The supporting plate 5 comprises a thin plate.

Preferably, the supporting plate 5 is made of a synthetic resin. The net-shaped sun shade 16 may be attached to the outer peripheral edge of the supporting plate 5 by stitching. As illustrated by the single-dotted line "a" in FIG. 3, the net-shaped sun shade 16 attached to the outer peripheral edge of the supporting plate 5 is rounded upwards, resulting in it being spaced from face portions of the user.

Meanwhile, a hinge pin 6 protrudes from an upper surface of the clipping part 4. Preferably, the hinge pin 6 protrudes from a surface of the upper clipping plate 2. A hinge hole 10 is formed through a front end of supporting ribs 9,9*a*, respectively. The hinge pin 6 is hingedly inserted into the hinge hole 10 formed at the front end of the supporting ribs 9,9*a*, respectively. A locking means is provided at a joint between the clipping part 4 and the supporting ribs 9,9*a*. This locking means allows the supporting ribs 9,9*a* to pivot with respect to the hinge pin 6 like a clock.

Figure 6:
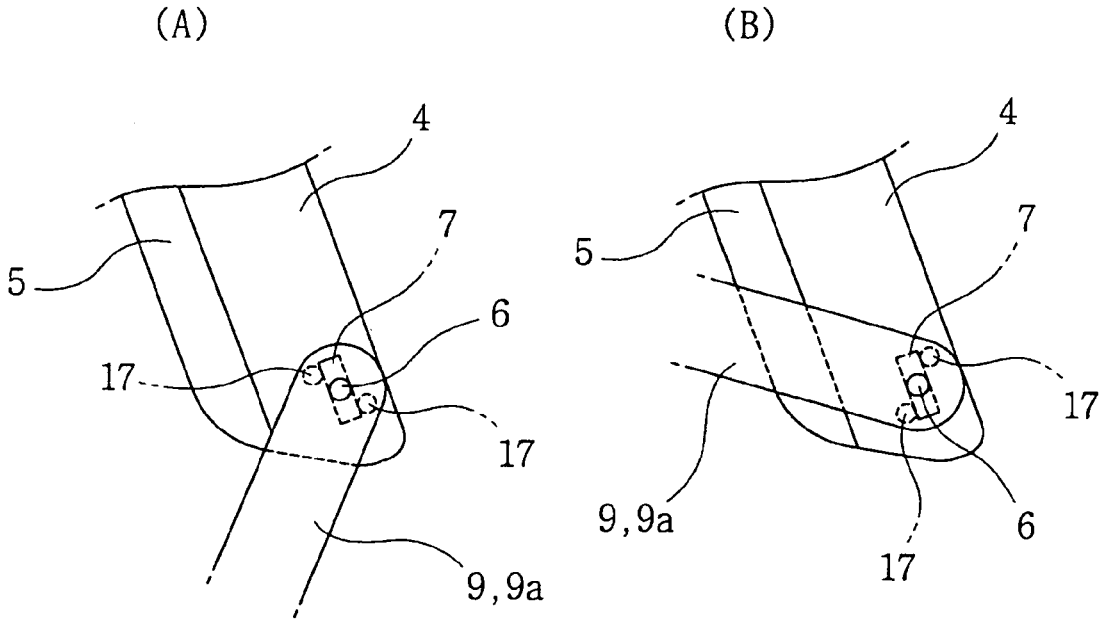
FIGS. 6A and 6B are fragmentary enlarged views showing the operation of the constitutional parts taken along the single-dotted circle line "B" as illustrated in FIG. 2.

A first embodiment of the locking means is shown in FIGS. 1 and 6. In the first embodiment of the locking means shown in FIGS. 1 and 6, the locking means comprises a locking protrusion 7 and a plurality of semispherically-shaped protrusions 17. The locking protrusion 7 protrudes from the upper surface of the clipping part 4 on which the hinge pin 6 also protrudes as described above. Preferably, the locking protrusion 7 protrudes from the surface of the upper clipping plate 2. The semispherically-shaped protrusions 17 protrude from the front end of the supporting ribs 9,9*a* at positions adjacent to the hinge hole 10. When the supporting ribs 9,9*a* pivot with respect to the hinge pin 6, the semispherically-shaped protrusions 17 may be temporarily caught on the locking protrusion 7.

Figure 7:
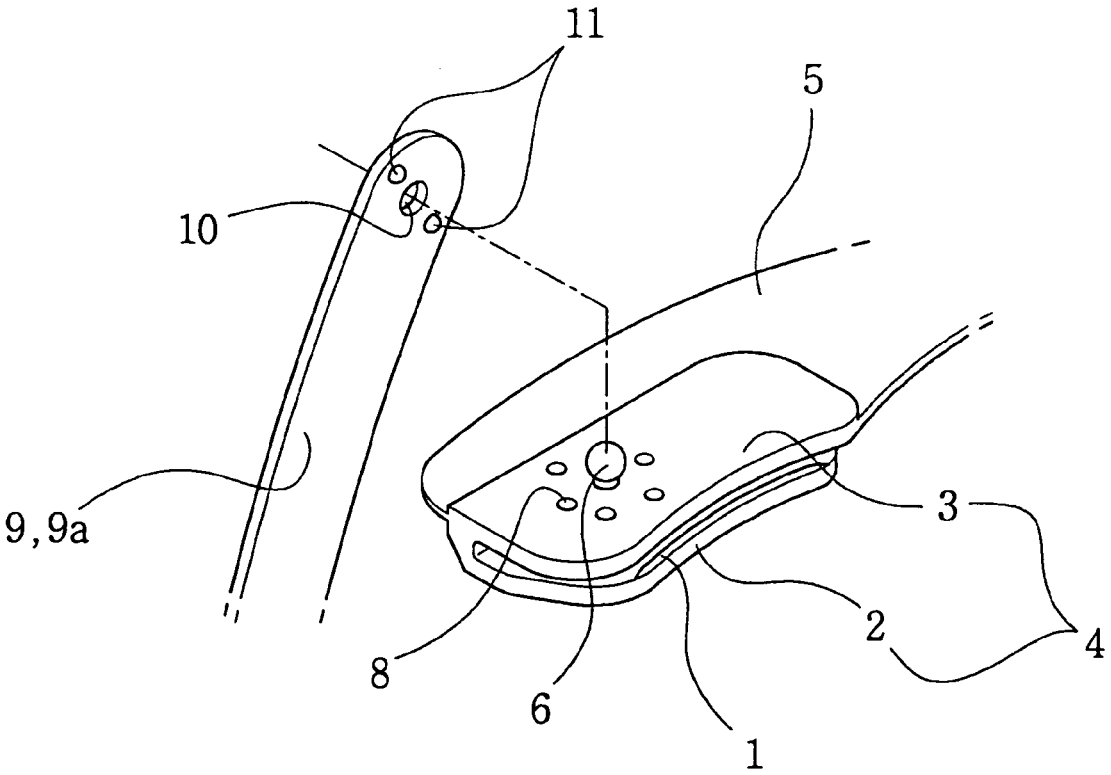
FIG. 7 is a fragmentary exploded perspective view showing the structure of the constitutional parts according to a second embodiment of the present invention, which taken along the single-dotted circle line "B" as illustrated in FIG. 2.

A second embodiment of the locking means is shown in FIG. 7. In the second embodiment of the locking means shown in FIG. 7, the locking means comprises a plurality of locking holes 8 and a plurality of semispherically-shaped protrusions 11. The locking holes 8 are formed on the upper surface of the clipping part 4 at a predetermined distance along an assumed concentric circle, on which the hinge pin 6 also protrudes as described above. Preferably, the locking holes 8 are formed on a surface of the lower clipping plate 3. The semispherically-shaped protrusions 11 protrude from the front end of the supporting ribs 9,9*a* at positions adjacent to the hinge hole 10. When the supporting ribs 9,9*a* pivot with respect to the hinge pin 6, the semispherically-shaped protrusions 11 may be temporarily caught in the locking holes 8.

As best seen in FIG. 1, a fitting element 12 protrudes one side surface of a lower portion of the supporting rib 9. An insertion element 14 corresponding to the fitting element 12 is formed at a lower end of the supporting rib 9*a*. The insertion element 14 is provided with an uneven part 13 and it can be inserted into the fitting element 12. Meanwhile, since the supporting ribs 9,9*a* are made of a soft synthetic resin and have a thin band shape, a front portion of the net-shaped sun shade 16 can be combined to the supporting ribs 9,9*a* by stitching.

Figure 8:
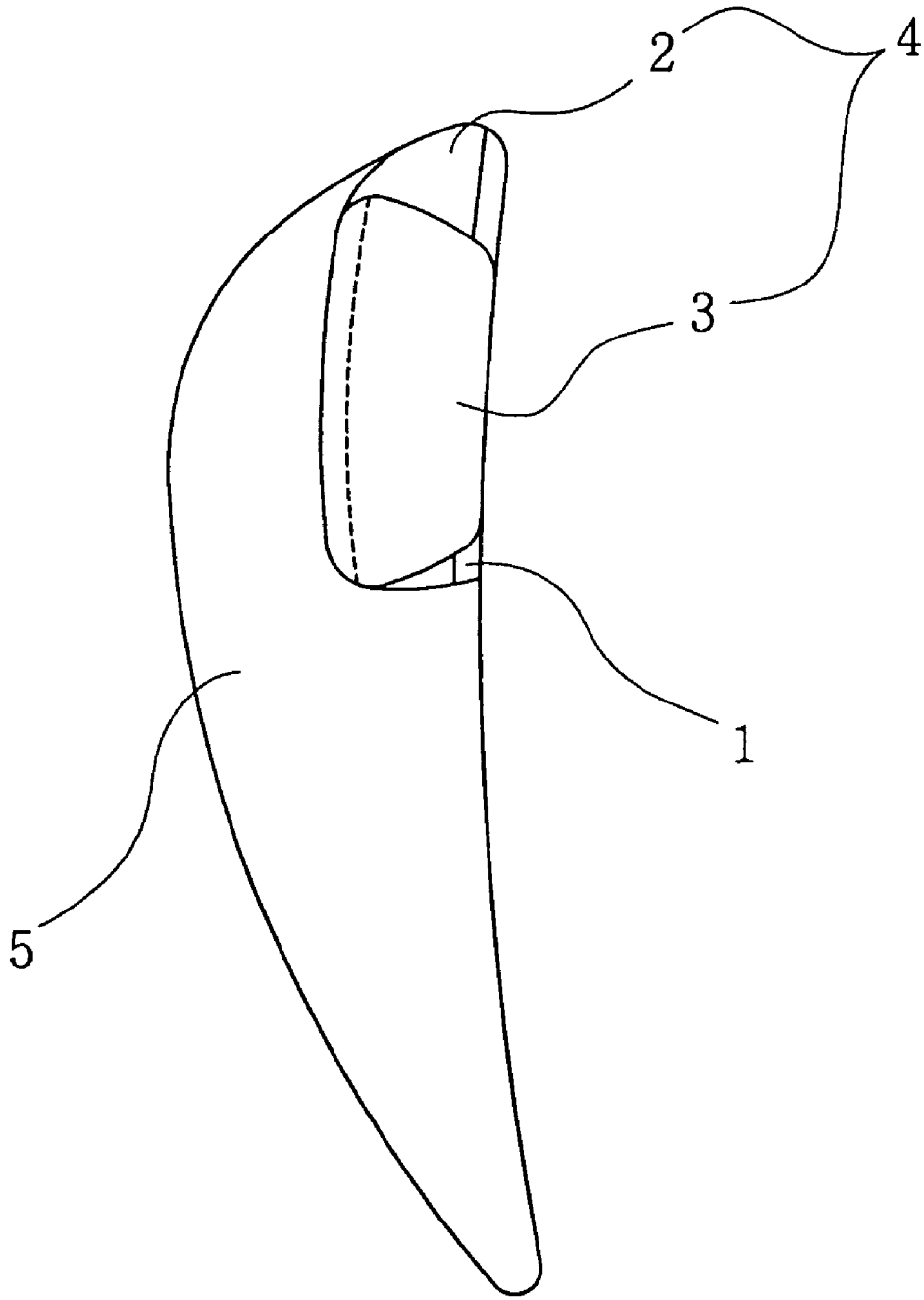
FIG. 8 is a bottom view of supporting plates according to the present invention.

As best seen in FIG. 8, the longitudinal length of the front and the rear ends of an upper clipping plate 2 are greater than that of the front and the rear ends of a lower clipping plate 3. Due to this structure, the visor 20 may be easily fitted between the upper clipping plate 2 and the lower clipping plate 3 of the clipping part 4.

Referring to FIG. 1, a holding element 18 having a generally hook-shape is formed on a rear upper edge side of the net-shaped sun shade 16 to hook and be partially inserted into a rear end of a hat or a safety helmet. An elastic cord is inserted into the upper portion of the net-shaped sun shade 16 that is supported between both supporting plates 5. When a shade curtain according to the present invention is mounted to a hat or a safety helmet, it can be tightly combined to the hat or the safety due to the elastic force of the elastic cord.

Figure 4:
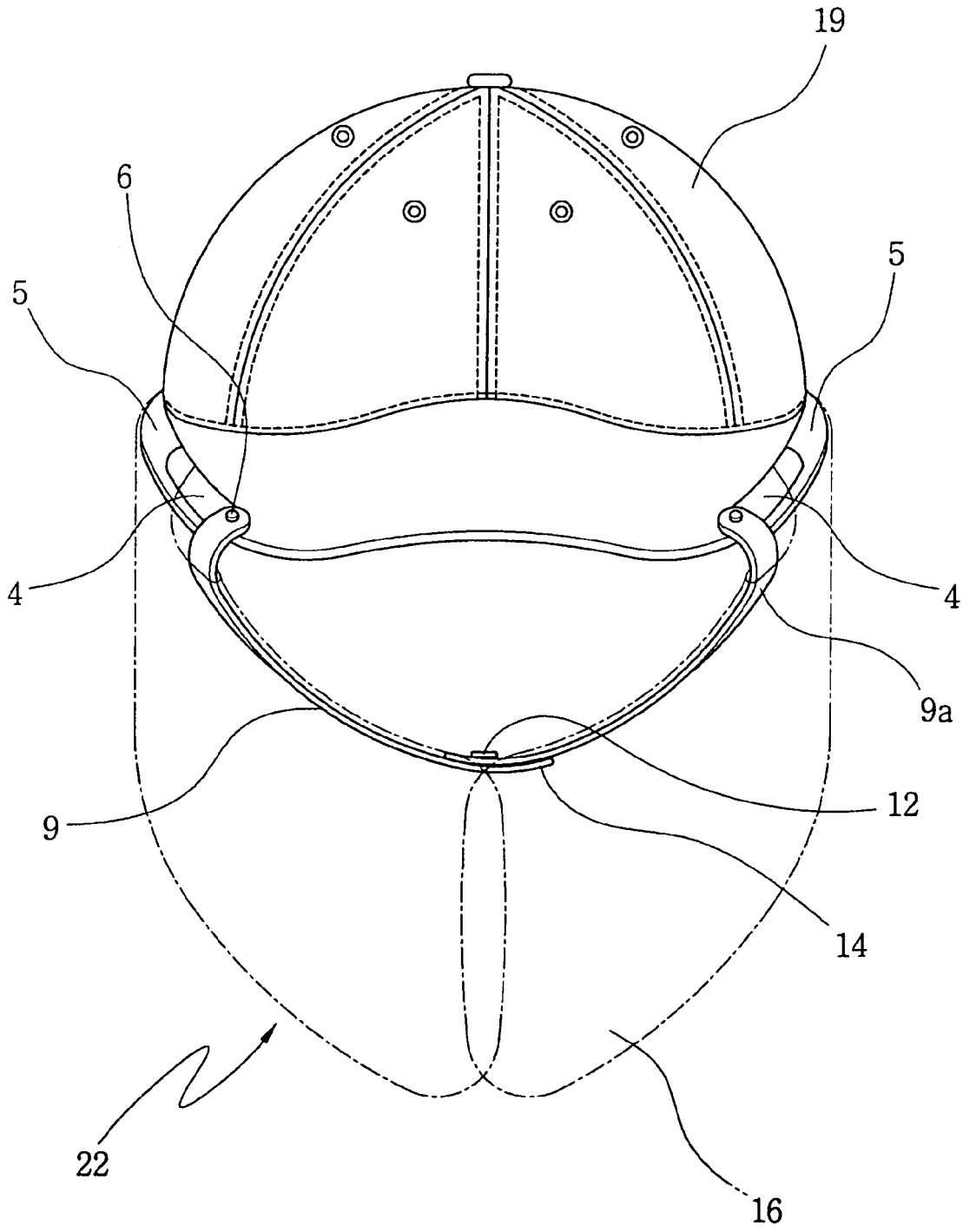
FIG. 4 is a front view showing a state that the shade curtain is installed at a hat.
Figure 5:
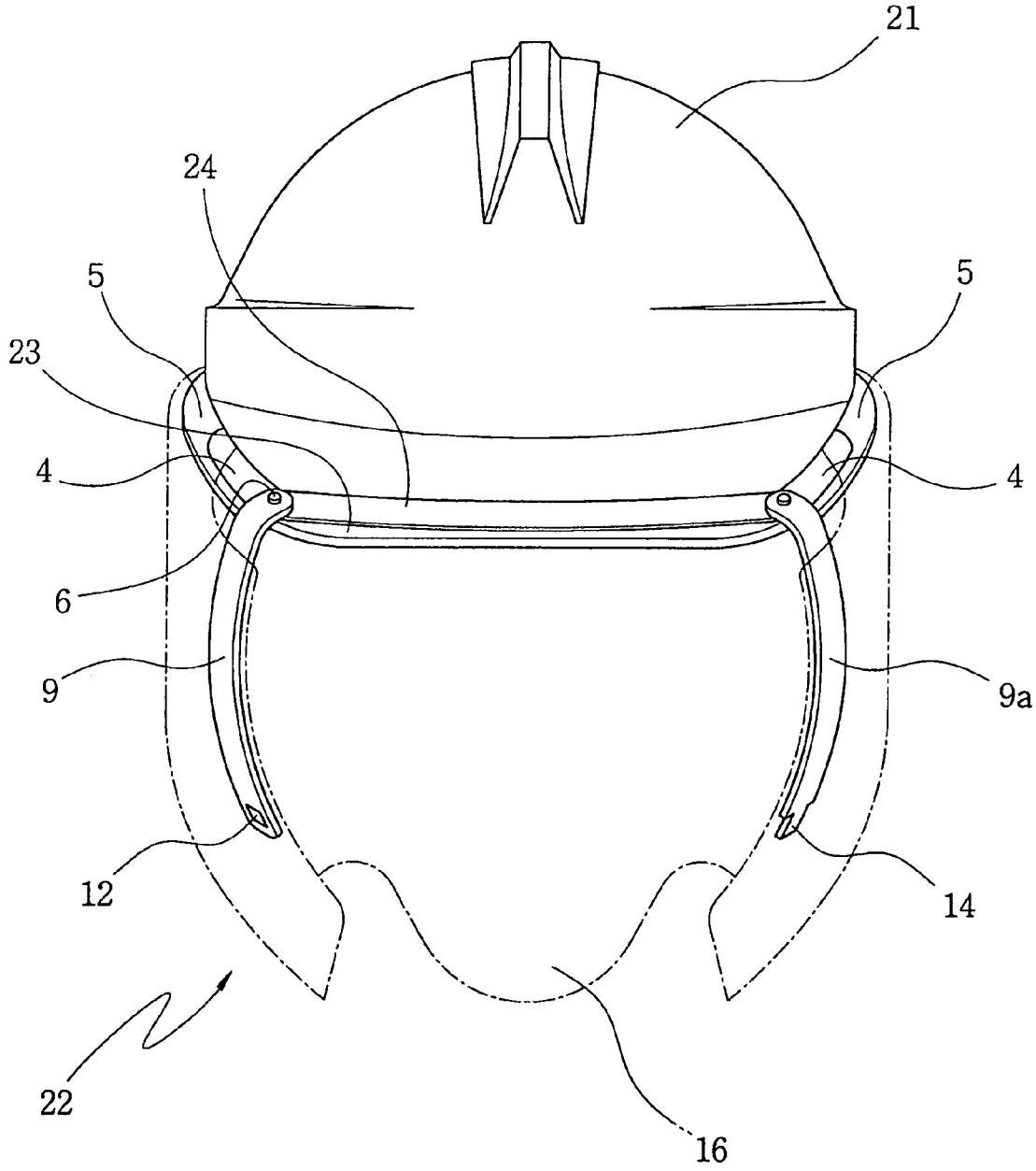
FIG. 5 is a front view showing a state that the shade curtain is installed at a safety hat.

FIG. 4 shows a state that the shade curtain 22 is installed at a hat 19 having a visor, and FIG. 5 shows a state that the shade curtain 22 is installed at a safety helmet 21, which is mainly used in industrial settings. Referring to FIG. 5, a connecting bar 24 is installed between the clipping parts 4. At this time, both ends of the connecting bar 24 are connected to the front portion of the clipping part4 respectively by receiving the hinge pin 6 protruding from the surface of the clipping part 4. This connecting bar 24 has a function of preventing the clipping part 4 fitted at a circumferential edge 23 of the safety helmet 21 from slipping backwards.

While the shade curtain according to the present invention has been particularly shown and described with reference to a hat and a safety helmet as illustrated in the accompanying drawings, it will be understood by those skilled in the art that the configuration of the shade curtain is not restricted to the above figures, and many variations in form and details can be made in various hats except for indoor hats without departing from the spirit and scope of the invention as defined by the appended claims.

Herein after, the second embodiment according to the present invention will be explained with reference drawing FIG. 9. The shade curtain according to the second embodiment has much the same constitution as that of the shade curtain according to the first embodiment of the present invention, except for the structure relevant to the net-shaped sun shade 16. In other words, in the first embodiment according to the present invention, the supporting plates 5 comprise a two-part supporting plate consisting of a left supporting plate and a right supporting plate. Alternatively, in the second embodiment, a rear supporting plate 15 is connected between the rear sides of the left supporting plate and the right supporting plate, and the net-shaped sun shade 16 is installed all over the outside of the shade curtain 22. It should be noted that, for the sake of clarity and understanding of the present invention, components identical to those of the first embodiment will be referred to using the same reference numerals, and detailed description thereof will be omitted. Also, identical components which have identical functions have been identified with identical reference numerals throughout the different views which are illustrated in each of the attached drawing Figures.

Hereinafter, the construction and the operation of the shade curtain according to the embodiments of the present invention as above will be described in detail with reference drawings FIGS. 1 to 9.

As shown in FIGS. 2 to 5, when the shade curtain 22 is installed at the hat 19, the clipping parts 4 are fitted to both sides of the visor 20. Alternatively, when the shade curtain 22 is installed at the safety helmet 21, the clipping parts 4 are tied to outwardly rounded portions at both sides of the front lower end of the safety helmet 21.

Hereinafter, the process for fitting the clipping parts 4 to both sides of the visor will be described.

The clipping part 4 is made of a synthetic resin by using the injection molding technique and it has a "ㄷ" shaped sectional surface, respectively. Due to this structure, the clipping part 4, which comprises a two-part clipping plate consisting of the upper clipping plate 2 and the lower clipping plate 3, is elastic. When the clipping parts 4 are mounted to both sides of the visor 20, the outer circumferential-edges of the upper and the lower clipping plates 2,3 show a tendency to shrink with each other due to the natural elasticity. Consequently, it is hard to install the clipping parts 4 at both sides of the visor 20.

Meanwhile, as shown in FIGS. 1 and 8, the longitudinal length of the front and the rear ends of the upper clipping plate 2 are greater than that of the front and the rear ends of the lower clipping plate 3. Due to this structure, the front and the rear ends of the upper clipping plate 2 are much more exposed to the outside than those of the lower clipping plate 3.

If a user pushes the clipping parts 4 toward both sides of the visor 20 after approaching the visor 20 between the exposed portion of the upper clipping plate 2 and the lower clipping plate 3 of the clipping parts 4, the visor 20 can squeeze through a gap between the upper clipping plate 2 and the lower clipping plate 3. Consequently, the clipping parts 4 having a "ㄷ" shaped sectional surface are fitted to both sides of the visor 20.

If the clipping parts 4 are fitted to both sides of the visor 20, the jaw 1 formed at the entrance between the upper clipping plate 2 and the lower clipping plate 3 bites the visor 20, thus keeping the clipping parts 4 strongly coupled to the visor 20 even when the latter is shaken.

When the clipping parts 4 are installed at both sides of the visor 20, the net-shaped sun shade 16 may enclose the side and the rear portions of the hat 19 except for the front portion of the hat 19. As described above, a part of the upper peripheral edge of the net-shaped sun shade 16 is attached to the outer circumferential edge of the supporting plate 5 by stitching.

Then, the holding element 18, which has a generally hook-shape and is formed on a rear upper edge side of the net-shaped sun shade 16, is inserted into a rear end of the hat 19. Consequently, the rear portions of the net-shaped sun shade 16 are coupled to the rear end of the hat 19.

When a user wears the hat 19 after installing the shade curtain 22 at the hat 19, the net-shaped sun shade 16 is spaced from face portions of the user. In other words, since the supporting plate 5 has a predetermined width and the net-shaped sun shade 16 is installed at the radial outside of the supporting plate 5, the net-shaped sun shade 16 is spaced from face portions of the user.

Figure 3:
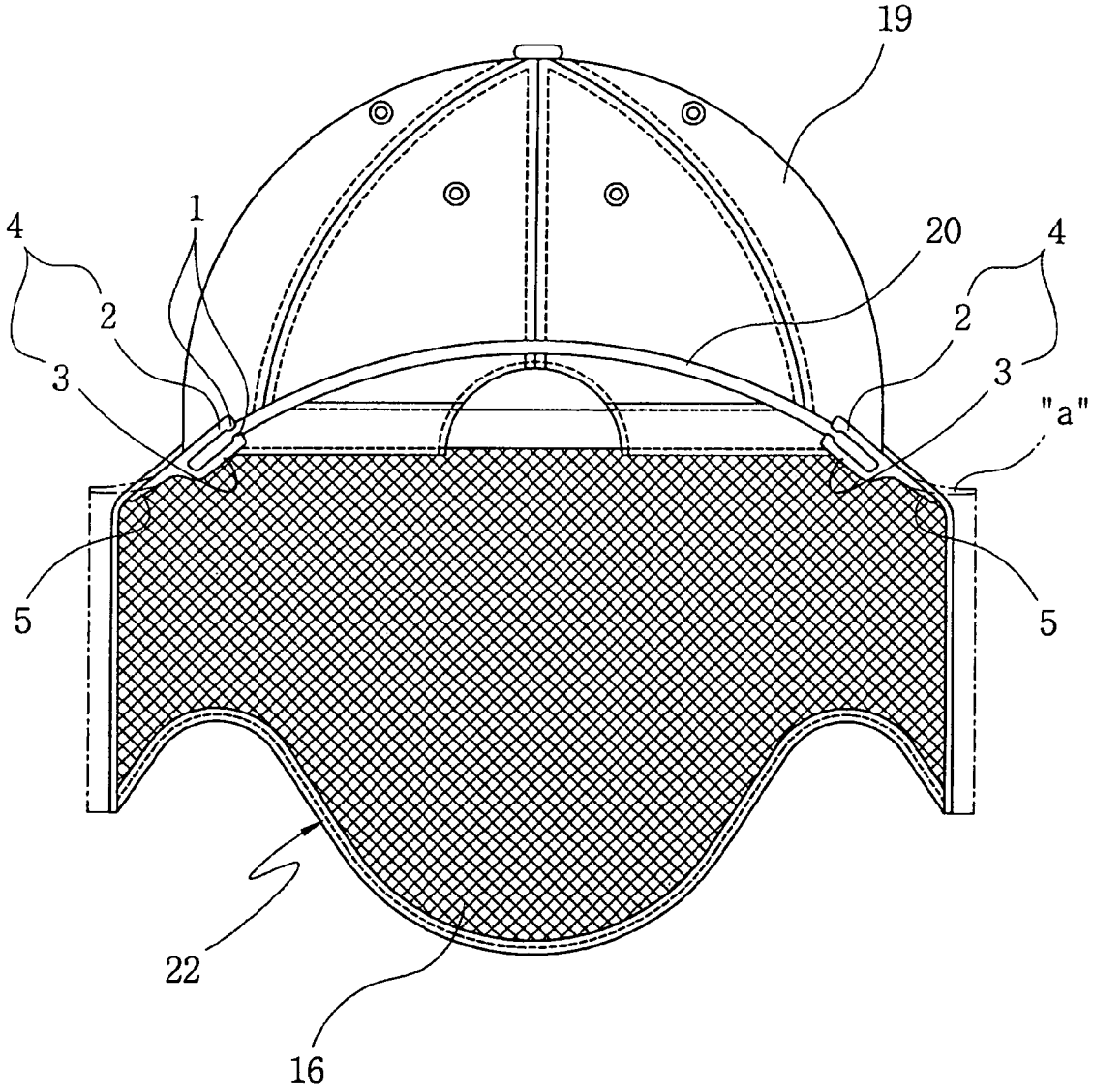
FIG. 3 is a sectional view taken along line A-A in FIG. 2.

The single-dotted line "a" in FIG. 3 shows the state that the outer peripheral edge of the supporting plate 5 is rounded upwards. As shown in FIG. 3, the net-shaped sun shade 16 has the lower peripheral edge that is rounded downwards. Assuming that if the outer peripheral edge of the supporting plate 5 is not rounded upwards, the net-shaped sun shade 16 installed at the radial outside of the supporting plate 5 may be contacted with the front portions of the user's face. Considering this circumstance, the outer peripheral edge of the supporting plate 5 is rounded upwards as illustrated in FIG. 3 by the single-dotted line "a". Due to this structure, the net-shaped sun shade 16 is spaced from face portions of the user.

Figure 2:
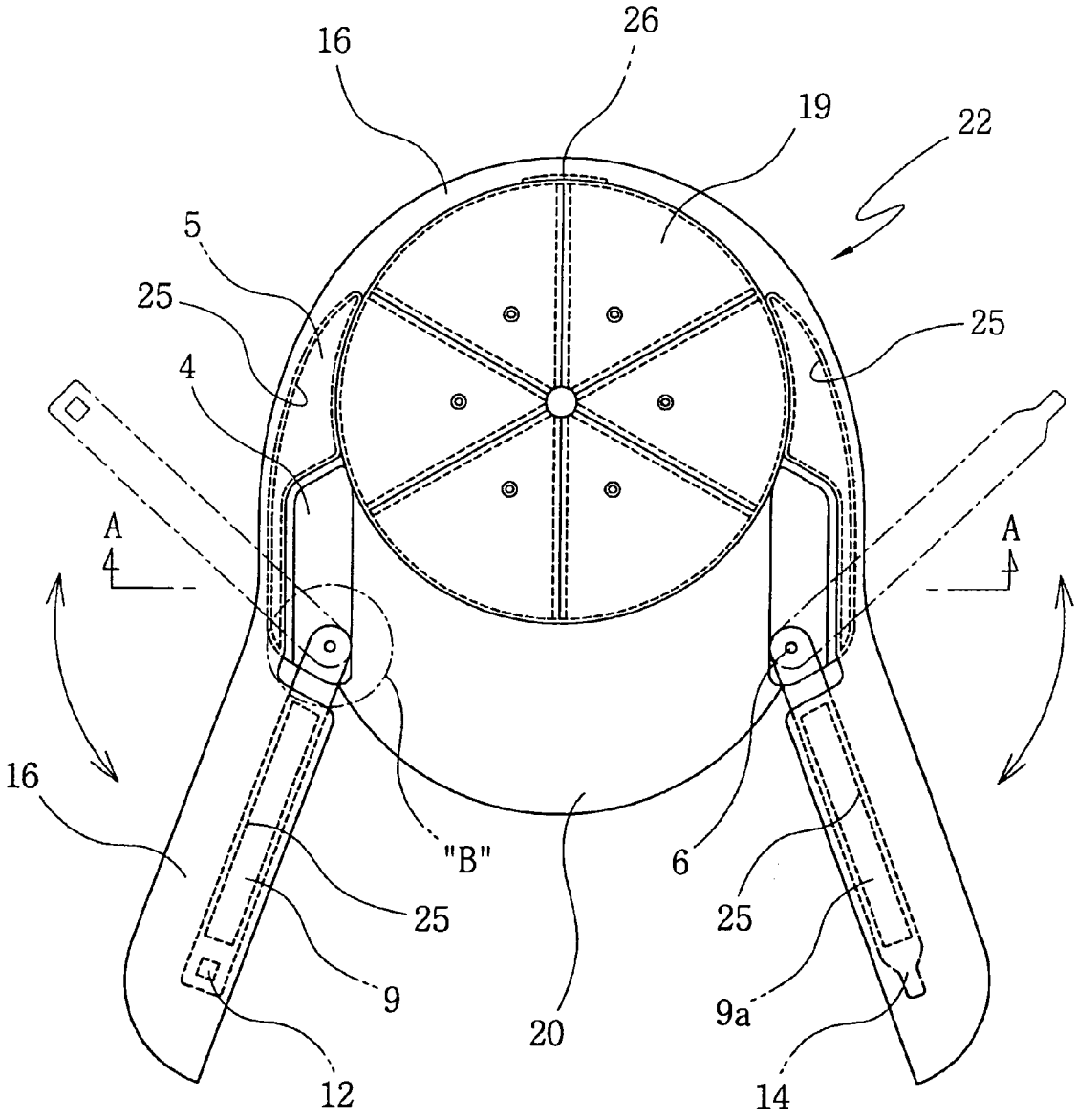
FIG. 2 is a plan view showing an installation state of the shade curtain as illustrated in FIG. 1.

If the user wants to further screen the front portions of the user's with wearing the hat on which the shade curtain 22 is installed, as shown in FIG. 2, the user makes the supporting ribs 9,9*a* to get in with each other by pivoting the supporting ribs 9,9*a* with respect to the hinge pin 6. Thereafter, if the insertion element 14 of the second supporting rib 9*a* is inserted into the fitting element 12 formed at the lower end of the first supporting rib 9, then the lower ends are close adjacent with each other. Consequently, a small open space is created in the front portions of the user's face and the other portions are closed by the net-shaped sun shade 16. Accordingly, the net-shaped sun shade 16 sufficiently screens the front portions of the face and the rear portions of the user's head from the sunlight or the insect.

As shown in FIG. 1, the insertion element 14 has an uneven part 13 on its one side surface. When the insertion element 14 is inserted into the fitting element 12, it is hardly released from the fitting element 12 due to the operation of the uneven part 13, and thereby it is possible to sustain the state that the supporting ribs 9,9*a* huddle up.

After using the shade curtain 2 under the state that the supporting ribs 9,9*a* huddle up, if the user wants to open the supporting ribs 9,9*a* wide, he or she can draw the insertion element 14 from the fitting element 12 and then can pivot the supporting ribs 9,9*a* with respect to the hinge pin 6 in order to open those outwards. Consequently, the supporting ribs 9,9*a* hingedly coupled by the hinge pin 6 become open outwards.

In the meantime, a locking means for allowing pivotal movement of the supporting ribs 9,9*a* is provided at a joint between the clipping parts 4 and the supporting ribs 9,9*a*, respectively. As shown in FIGS. 1 and 6, the locking means according to the first embodiment of the present invention comprises a locking protrusion 7 and a plurality of semi-spherically-shaped protrusions 17. As described above, the locking protrusion 7 protrudes from the upper surface of the clipping part 4 on which the hinge pin 6 also protrudes there from. Furthermore, the semispherically-shaped protrusions 17 protrude from the front end of the supporting ribs 9,9*a* at positions adjacent to the hinge hole 10. When the supporting ribs 9,9*a* pivots with respect to the hinge pin 6, the semi-spherically-shaped protrusions 17 may be temporarily caught on the locking protrusion 7 along the diagonal line direction.

Alternatively, as shown in FIG. 7, the locking means according to the second embodiment of the present invention comprises a plurality of locking holes 8 and a plurality of semispherically-shaped protrusions 11. As described above, the locking holes 11 are formed on the upper surface of the clipping part 4 at a predetermined distance along an assumed concentric circle, on which the hinge pin 6 also protrudes. Furthermore, the semispherically-shaped protrusions 11 protrude from the front end of the supporting ribs 4,4*a* at positions adjacent to the hinge hole 10. When the supporting ribs 9,9*a* pivot with respect to the hinge pin 6, the semispherically-shaped protrusions 11 may be temporarily caught in the locking holes 8.

Figure 9:
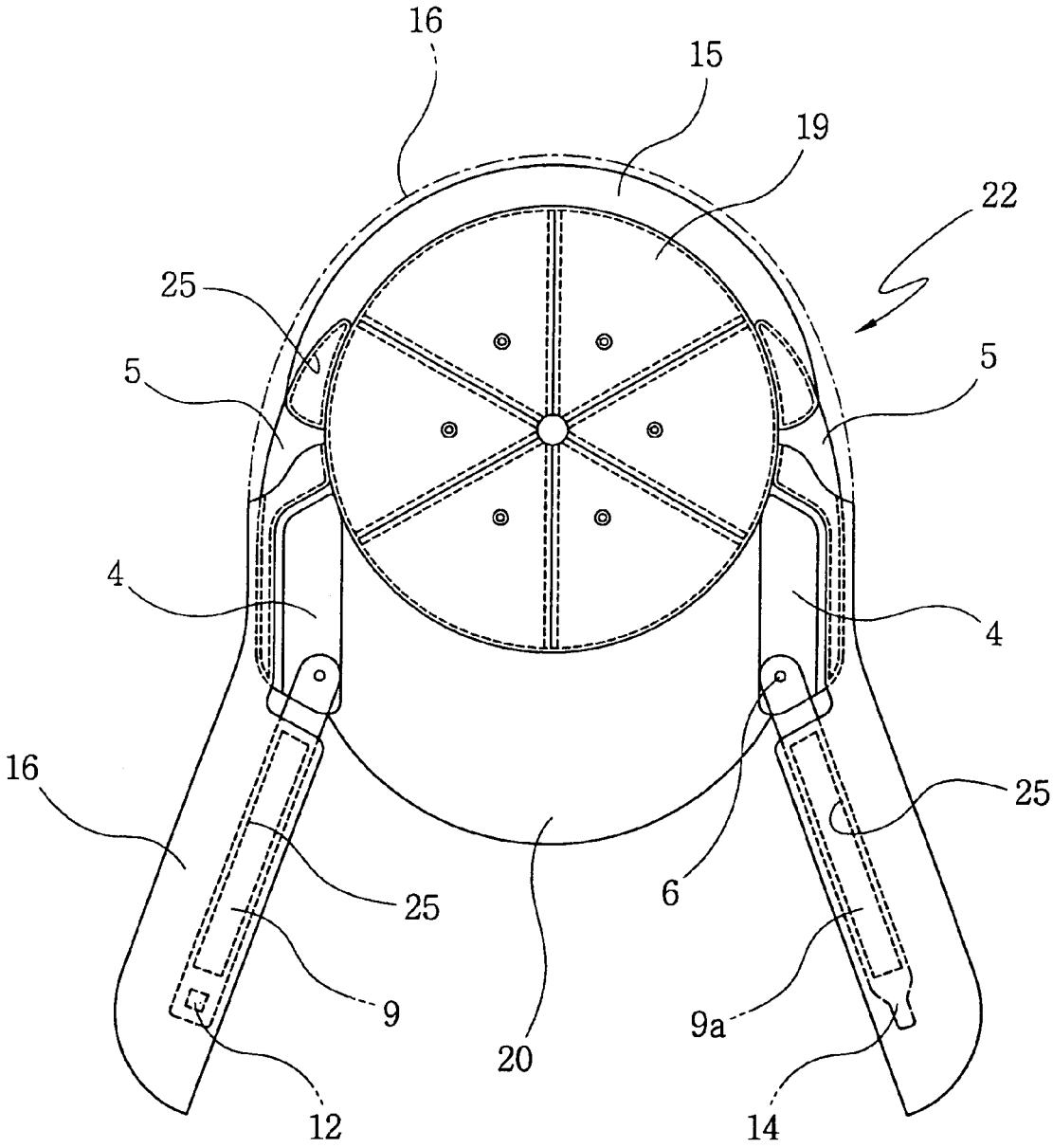
FIG. 9 is a plan view showing an installation state of a shade curtain freely attachable to and detachable from a hat according to a second embodiment of the present invention.

FIG. 9 shows the shade curtain according to the second embodiment of the present invention. As described above, the shade curtain according to the second embodiment has much the same constitution as that of the shade curtain according to the first embodiment of the present invention, except for the structure relevant to the net-shaped sun shade 16. In other words, in the first embodiment according to the present invention, the supporting plates 5 comprise a two-part supporting plate consisting of a left supporting plate and a right supporting plate. Alternatively, in the second embodiment, a rear supporting plate 15 is connected between the rear sides of the left supporting plate and the right supporting plate, and the net-shaped sun shade 16 is installed all over the outside of the shade curtain 22. It should be noted that, for the sake of clarity and understanding of the present invention, components identical to those of the first embodiment will be referred to using the same reference numerals, and detailed description thereof will be omitted.

In the second embodiment, the rear supporting plate 15 having a predetermined width is additionally installed between the rear sides of the supporting plates 5, and a part of the upper peripheral edge of the net-shaped sun shade 16 is attached to the outer circumferential edge of the rear supporting plate 15 by stitching, resulting in it being spaced from rear portions of the user' head. When the user wears on the safety helmet 21, in which the shade curtain 22 is attached thereto, he or she feels at ease.

While the shade curtain according to the present invention has been particularly shown and described with reference to a hat and a safety helmet as illustrated in the accompanying drawings, it will be understood by those skilled in the art that the configuration of the shade curtain is not restricted to the above figure, and many variations in form and details can be made in various hats without departing from the spirit and scope of the invention as defined by the appended claims. Preferably, the shade curtain comprises a net or a lattice screen member, which is constructed of flexible strands in close proximity of each other, and thereby it has a function of screening the user's face from the sunlight or the insect and of allowing air ready access to the user's face. However, the shade curtain comprises a net-like device that is constructed of a non-woven fabric or a variety of fabrics. Particularly, when the shade curtain is installed at the safety helmet, it can comprise a towel constructed of a paper so as to wipe the sweat off user's face with it.

The reference numeral "25" as shown in FIGS. 2 and 9 represents a seaming line. Also, the reference numeral "26" represents an elastic band portion of which an elastic cord is inserted therein.

According to the present invention, the shade curtain includes the supporting plate on which the net-shaped sun shade is attached, and the clipping part combined to the visor, which are integrally formed with each other. A locking means is installed at a joint between the front ends of both supporting ribs for supporting the front portion of the net-shaped sun shade and the clipping part. Accordingly, it is possible to obtain a considerable reduction in costs by simplifying the structure as described above so as to reduce the size and weight of the sunshade. Furthermore, it is possible to obtain a considerable improvement in value of commodities by decorating the outward appearance of the shade curtain for screening a user's face from the sunlight or the insect. In addition, it is possible to make the user much more conveniently use the shade curtain than a conventional shade curtain for a hat by employing the locking means for stably supporting a net-shaped sun shade. Furthermore, the shade curtain according to the present invention can provide the user with more options and features.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A shade curtain freely attachable to and detachable from a hat, the shade curtain including clipping parts being attachable to and detachable from both sides of a visor of the hat, supporting plates for enclosing side circumferential-edges of the hat respectively, net-shaped sun shades being attached to and extending downwards from outer peripheral edges of the supporting plates, and supporting ribs for supporting front upper edges of the net-shaped sun shades respectively, which are hingedly mounted to front ends of the clipping parts respectively, characterized in that:

the clipping parts have a "⊏" shape sectional surface respectively, in which a jaw for holding the visor fitted between an upper clipping plate and a lower clipping plate of the clipping parts is formed at an entrance there between, in which the supporting plates are made of a thin plate and they are integrally coupled to the outside and the rear side of the clipping parts respectively, in which a hinge pin protrudes from an upper surface of the front end of the clipping parts respectively, and a hinge hole is formed through a front end of supporting rib respectively, and thereby the hinge pin is hingedly inserted into the hinge hole, in which a locking means is provided at a joint between the clipping parts and the supporting ribs respectively, in which a fitting element protrudes one side surface of a lower portion of one supporting rib, and an insertion element having a uneven part, which is correspond to the fitting element, is formed at a lower end of the other supporting rib, and thereby the insertion element is inserted into the fitting element.

2. The shade curtain as claimed in claim 1, wherein the supporting plates comprise a two-part supporting plate consisting of a left supporting plate and a right supporting plate, wherein a rear supporting plate is connected between the rear sides of the left and the right supporting plates, and wherein the net-shaped sun shade is attached to the outer circumferential edges of the supporting ribs, the supporting plate and the rear supporting plate at its upper peripheral edge and it extend downwards at a predetermined length.

3. The shade curtain as claimed in claims 1 or 2, wherein the longitudinal length of the front and the rear ends of the upper clipping plate are greater than that of the front and the rear ends of the lower clipping plate.

4. The shade curtain as claimed in claim 3, wherein the locking means comprises a locking protrusion and a plurality of semispherically-shaped protrusions, in which the locking protrusion protrudes from the upper surface of the clipping part on which the hinge pin also protrudes there from, in which the semispherically-shaped protrusions protrude from the front end of the supporting ribs at positions adjacent to the hinge hole, when the supporting rib pivots with respect to the hinge pin on the locking protrusion, the semispherically-shaped protrusions can be locked on the locking protrusion with making the clicking sound.

5. The shade curtain as claimed in claim 3, wherein the locking means comprises a plurality of locking holes and a plurality of semispherically-shaped protrusions, in which the locking holes are formed on the upper surface of the clipping part at a predetermined distance along an assumed concentric circle, on which the hinge pin also protrudes, wherein the semispherically-shaped protrusions protrude from the front end of the supporting ribs at positions adjacent to the hinge hole, when the supporting rib pivots with respect to the hinge pin on the upper surface of the clipping part, the semispherically-shaped protrusions can be locked in the locking holes with making the clicking sound.

6. The shade curtain as claimed in claim 3, wherein a holding element having a generally hook-shape is formed on a rear upper edge side of the net-shaped sun shade to hook and be partially inserted into a rear end of a hat or a safety helmet.

7. The shade curtain as claimed in claim 3, wherein a part of the supporting plate is upwardly rounded at a predetermined slanted angle.

8. The shade curtain as claimed in claim 3, wherein a connecting bar for preventing the clipping parts attached to both sides of the visor of the hat from being slipped rewards is installed at the front of the visor between both clipping parts, in which both ends of the connecting bar are hingedly fitted to the hinge pins protruding from the upper surfaces of the clipping parts.

* * * * *